United States Patent [19]

Naruse et al.

[11] Patent Number: 4,912,008

[45] Date of Patent: Mar. 27, 1990

[54] METHOD OF ANNEALING ELECTROPHOTOGRAPHIC PHOTOSENSITIVE DEVICE

[75] Inventors: Megumi Naruse, Hitachi; Kunihiro Tamahashi, Mito; Mitsuo Chigasaki, Hitachi; Masanobu Hanazono, Mito, all of Japan

[73] Assignee: Hitachi, Ltd., Tokyo, Japan

[21] Appl. No.: 201,326

[22] Filed: May 31, 1988

Related U.S. Application Data

[62] Division of Ser. No. 816,304, Jan. 6, 1986, abandoned.

[30] Foreign Application Priority Data

Jan. 9, 1985 [JP] Japan ..... 60-844

[51] Int. Cl.[4] ..... G03G 5/14; G03G 5/082

[52] U.S. Cl. ..... 430/130; 430/132; 430/136

[58] Field of Search ..... 430/130, 132, 136

[56] References Cited

U.S. PATENT DOCUMENTS

| | | | |
|---|---|---|---|
| 3,617,265 | 11/1971 | Pertuzella | 430/130 X |
| 4,361,638 | 11/1982 | Higashi et al. | 430/66 X |
| 4,394,425 | 7/1983 | Shimizu et al. | 430/66 X |
| 4,472,492 | 9/1984 | Kanbe et al. | 430/130 |
| 4,477,549 | 10/1984 | Fujimaki et al. | 430/66 X |
| 4,510,224 | 4/1985 | Yamazaki et al. | 430/57 |
| 4,559,289 | 12/1985 | Sunagawa et al. | 430/67 X |
| 4,582,769 | 4/1986 | Kido et al. | 430/66 X |
| 4,661,427 | 4/1987 | Kanai | 430/66 X |

FOREIGN PATENT DOCUMENTS

| | | | |
|---|---|---|---|
| 56-69638 | 6/1981 | Japan | 430/130 |
| 59-154455 | 9/1984 | Japan | 430/66 |

OTHER PUBLICATIONS

Caesar et al., "Improvement of the Xerographic Properties of a Si:H by Annealing Processes", Xerox Discl. Jour., vol. 10, No. 4, Jul./Aug. 1985, pp. 185–186.

*J. Appl. Phys.* 53(11), Nov. 1982, "Defects in Hydrogenated Amorphous Silicon–Carbon Alloy Films Prepared by Glow Discharge Decomposition and Sputtering", Morimoto et al., pp. 7299–7305.

*Primary Examiner*—Roland E. Martin

*Attorney, Agent, or Firm*—Antonelli, Terry & Wands

[57] ABSTRACT

In an electrophotographic photosensitive device, which comprises an electroconductive support, a photoconductive layer provided thereon, and a surface protective layer provided on the photoconductive layer, the surface protective layer being made from a film having a density of localized states of not more than $5\times10^{17}$ $cm^{-3}$ and a higher dark resistance than that of the photoconductive layer, the surface protective layer is less susceptible to deterioration, adhesion to the photoconductive layer is enhanced, and thus the device has a prolonged life.

24 Claims, 4 Drawing Sheets

METHOD OF ANNEALING ELECTROPHOTOGRAPHIC PHOTOSENSITIVE DEVICE

This application is a division of application Ser. No. 816,304, filed Jan. 6, 1986 now abandoned.

BACKGROUND OF THE INVENTION

This invention relates to a novel electrophotographic photosensitive device, and more particularly to an electrophotographic photosensitive device having a surface protective layer of low density of localized states on the surface of a photoconductive layer, which is suitable for a laser beam printer, a copying machine, etc.

The electrophotographic photosensitive device, which the present invention is directed to, has hydrogen-containing amorphous silicon, or organic photoconductor as a material for the photoconductive layer. The present invention is particularly suitable to an electrophotographic photosensitive device using hydrogen-containing amorphous silicon as a photoconductive material.

Some of the electrophotograhic photosensitive devices use hydrogen-containing amorphous silicon or selenium or organic photoconductor as a material for the photoconductive layer.

Different from the electrophotographic photosensitive device using selenium as a material for the photoconductive layer, the electrophotographic photosensitive device using hydrogen-containing amorphous silicon as a material for the photoconductive layer has no toxicity and is easy to handle. It is also equivalent with respect to the photosensitivity, photo response, dark resistance, etc., to the electrophotographic photosensitive device using selenium as a material for the photoconductive layer. Furthermore, the hydrogen-containing silicon has a higher hardness than that of selenium, and thus an electrophotographic photosensitive device with a long life can be expected. However, it has a poor moisture resistance and a poor corona resistance and is also more susceptible to light deterioration. Thus, a satisfactory electrophotographic photosensitive device with a long life has not been obtained yet.

In an electrophotographic process applicable to a laser beam printer or a copying machine, on the other hand, the surface electric charge is made to be scattered by a carrier generated by light exposure, after the surface of the photosensitive device has been kept at a high potential, and thus the photosensitive device must take a structure of high electric resistance so as to keep a substantial surface potential. However, a hydrogen-containing amorphous silicon prepared by glow discharge can have a dark resistance as high as only $10^9$–$10^{10}$ Ω·cm and cannot have a higher resistance. To overcome the disadvantage, an electrophotographic photosensitive device using carbon, nitrogen or oxygen-containing amorphous silicon to increase the resistance as a surface layer has been disclosed [e.g. Japanese Patent Application Kokai (Laid-open) No. 54-145,537]. However, it has been found that the carbon, nitrogen or oxygen-containing amorphous silicon film with a higher resistance is liable to undergo deterioration like the hydrogen-containing amorphous silicon. Furthermore, the carbon, nitrogen or oxygen-containing amorphous silicon has a poor adhesion to the hydrogen-containing amorphous silicon, and thus can be easily peeled off.

SUMMARY OF THE INVENTION

An object of the present invention is to provide a novel electrophotographic photosensitive device having a surface protective layer, which is less susceptible to deterioration, and has a good adhesion to the photoconductive layer, i.e. less peelable therefrom.

The present invention provides an electrophotographic photosensitive device having a film of high electric resistance, whose local level density is not more than $5\times10^{17}$ cm$^{-3}$ and whose dark resistance is larger than that of the photoconductive layer, as a surface protective layer.

The present electrophotographic photosensitive device comprises a support of at least an electroconductive material, a photoconductive layer of hydrogen-containing amorphous silicon or organic photoconductor provided on the surface of the support, and a film of high electric resistance, whose density of localized states is not more than $5\times10^{17}$ cm$^{-3}$ and whose dark resistance is larger than that of the photoconductive layer, provided as a surface protective layer on the surface of the photoconductive layer.

The present electrophotographic photosensitive device can have a barrier layer capable of inhibiting injection of a carrier from the support of the electroconductive material to the photoconductive layer between the support and the photoconductive layer.

The barrier layer can be prevented from deterioration and its adhesion to the support and the photoconductive layer can be enhanced by using the same material for the barrier layer as that for the surface protective layer.

The present inventors have investigated why materials so far known for the film of high electric resistance on the surface of electrophotographic photosensitive device, i.e. carbon, nitrogen, or oxygen-containing amorphous silicon, have a poor moisture resistance, a poor corona resistance, a poor light-resistance fatigue, and an easy deterioration. It has been found that the so far known films of high electric resistance have a high density of localized states and thus an easy deterioration. That is, the higher the local level density, structurally the more unstable and chemically the more active the films. Thus, the films change with time or are more susceptible to influences of external factors such as air or light and are liable to undergo deterioration. Furthermore, the higher the local level density, the rougher the surfaces of films and the worse the adhesion to the photoconductive layer.

Heretofore, only the electric resistance of the surface protective film of the electrophotographic photosensitive device has been studied, and the density of localized states has not been studied at all. It is in the present invention that the local level density of a film of high electric resistance has been taken into account for the first time.

The film of high electric resistance used as a surface protective layer acts to block the carrier from the surface of the photoconductive layer, and thus must have a higher dark resistance than that of the photoconductive layer.

The photoconductive layer must have a dark resistance of $10^{12}$ to $5\times10^{13}$ Ω·cm so that an electrophotographic photosensitive device may have a higher surface potential than 500 V which is required in the dark. However, the hydrogen-containing amorphous silicon has a dark resistance as high as $10^9$ to $10^{10}$ Ω·cm, as described before. By providing a surface protective layer having a dark resistance of at least $5\times10^{13}$ Ω·cm on an photoconductive layer of hydrogen-containing amorphous silicon, the surface potential can be kept at more than 500 V, when the hydrogen-containing amorphous silicon is used as a photoconductive layer. In other words, it is preferable, when a hydrogen-containing amorphous silicon is used as a photoconductive layer, that the dark resistance of the surface protective layer is $5\times10^{13}$ Ω·cm or higher.

The local level density of a film of high electric resistance as a surface protective layer is not more than $5\times10^{17}$ $cm^{-3}$, preferably not more than $10^{17}$ $cm^{-3}$.

The density of localized states of the surface protective layer can be decreased preferably by annealing the film, or intensively doping hydrogen or halogen thereto as a material for compensating for the unsaturated bond. Annealing of the film can enhance the adhesion between the surface protective layer and the photoconductive layer through diffusion of atoms. The annealing can be carried out in the atmosphere as such for making the film or in an inert atmosphere. When the annealing of a film is carried out at a high temperature, hydrogen, etc. are discharged from the film, and thus the annealing may be carried out in an atmosphere under an elevated hydrogen partial pressure to compensate for the hydrogen. The annealing temperature depends on the composition of a surface protective layer, and desirably is 250° to 400° C., because the structure relaxation due to the diffusion of atoms is not enough at a lower annealing temperature, whereas at a higher temperature a large amount of the film-constituting atoms are disengaged therefrom as gaseous molecules, resulting in an undesirable increase in the local level density to the contrary.

The film as a surface protective layer can be prepared by chemical vapor deposition (CVD) of a mixture of silane with at least one of hydrocarbons, nitrides and oxides, or by sputtering onto a silicon target in an atmosphere containing at least one of hydrocarbons, nitrides, oxides, hydrogen and argon. The target for the sputtering is not only silicon, but may be also silicon carbide, etc. Amorphous silicon carbide, amorphous silicon nitride, amorphous silicon oxide, or their mixture can be obtained by CVD or by sputtering. A hydrogen-containing amorphous silicon carbide is a very suitable material for the surface protective layer.

In the present electrophotographic photosensitive device, aluminum, or aluminum alloys, stainless steel, brass, etc. can be used as a material for the support. The support may be, for example, in a cylindrical form, preferably, with a mirror-polished surface.

In the present electrophotographic photosensitive device, deterioration of a barrier layer itself can be prevented by using the same material for the barrier layer as that for the surface protective layer, and furthermore the adhesion between the photoconductive layer and the support can be enhanced.

It is preferable that the surface protective layer has a thickness of 0.05 to 0.2 μm, the photoconductive layer has a thickness of 10 to 30 μm, and the barrier layer has a thickness 0.05 to 0.2 μm. The support in a cylindrical form can have a thickness of 1 to 10 μm.

BRIEF DESCRIPTION OF THE DRAWINGS

In FIG. 1, one embodiment of the present electrophotographic photosensitive device without any barrier layer is shown. Support 100 is, for example, in a cylindrical form, and is made from an aluminum bulk material. A photoconductive layer 200 made from hydrogen-containing amorphous silicon is provided on the surface of a support 100, and is formed by sputtering or by CVD. As a surface protective layer 300, a film of high electrical resistance having a density of localized states of not more than $5\times10^{17}$ $cm^{-3}$ and a higher dark resistance than that of the photoconductive layer is provided on the photoconductive layer 200, and is formed by sputtering or by CVD.

In FIG. 2 is shown the structure of an electrophotographic photosensitive device, where a barrier layer 400 that prevents injection of a carrier from the support to the photoconductive layer is provided between the support 100 and the photoconductive layer 200. It is preferable that the barrier layer is made from the same material as that of the surface protective layer 300.

In FIG. 3 is shown an amorphous silicon-sputtering apparatus as one example of an apparatus for preparing the present electrophotographic photosensitive device, where any of drum form support and plate-form support can be used by changing a support holder 3. Basically, sputtering operation is carried out in the following manner. To form a photoconductive layer on a support made from an electroconductive material, a reactor vessel 1 in FIG. 3 is evacuated to $4\times10^{-7}$ Torr, and the reactor vessel 1 is heated to 200° C. by an external heater and a support 100 is heated to 400° C. by an internal heater, while degassing the reactor vessel 1. Then, the reactor vessel 1 is spontaneously cooled, whereas the support 100 is cooled to 250° C. and kept at that temperature.

Figure 1:
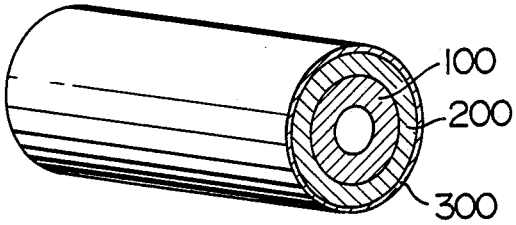
FIG. 1 is a cross-sectional view of an electrophotographic photosensitive device according to one embodiment of the present invention.
Figure 2:
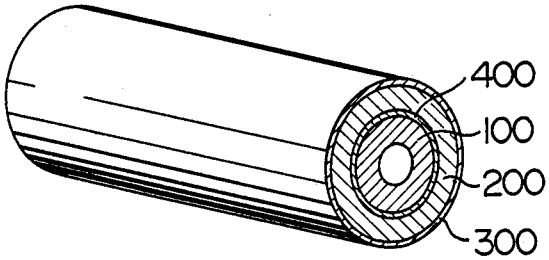
FIG. 2 is a cross-sectional view of an electrophotographic photosensitive device according to another embodiment of the present invention.

The reactant gas is prepared in the following manner.

Argon from a cylinder 9 and hydrogen from a cylinder 10 are adjusted to prdetermined flow rates through mass flow controllers 6 and 7, respectively, and led to a gas mixer 5. Methane from a cylinder 11 is adjusted to a predetermined flow rate through a mass flow controller 8. Then, the argon, hydrogen and methane are adjusted to $1\times10^{-3}$ Torr in the reactor vessel 1 through a needle valve 12, and then adjusted to $5\times10^{-3}$ Torr by a main vessel 13. Silicon target 4 has a purity of at least 99.99%. Sputtering is carried out by supplying a high frequency power from a power source 14. Before the sputtering a shutter 15 is closed and presputtering is conducted for 20 minutes. Then, the shutter 15 is opened to start the sputtering. The support temperature is adjusted to a constant during the sputtering, and when a film of desired thickness is obtained, the power source 14 is turned off, and then the needle valve 12 is closed. Then, the reactor vessel 1 is evacuated, and the suppor 100 is spontaneously cooled to room temperature.

PREFERRED EMBODIMENTS OF THE INVENTION

EXAMPLE 1

Figure 3:
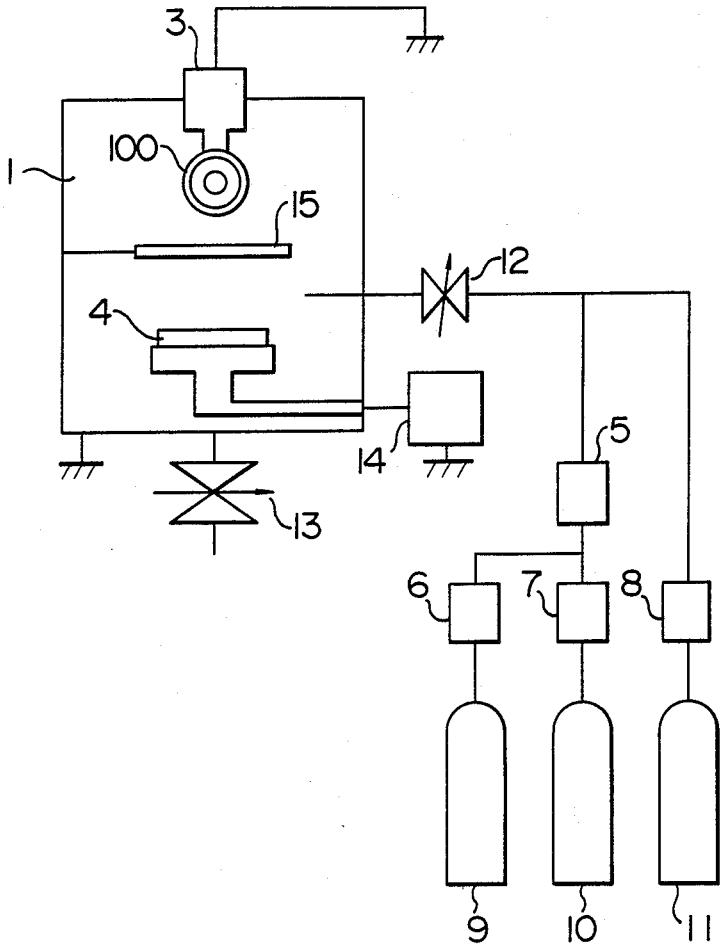
FIG. 3 is a schematic structural view showing a sputtering apparatus for use in the embodiments of the present invention.
Figure 4:
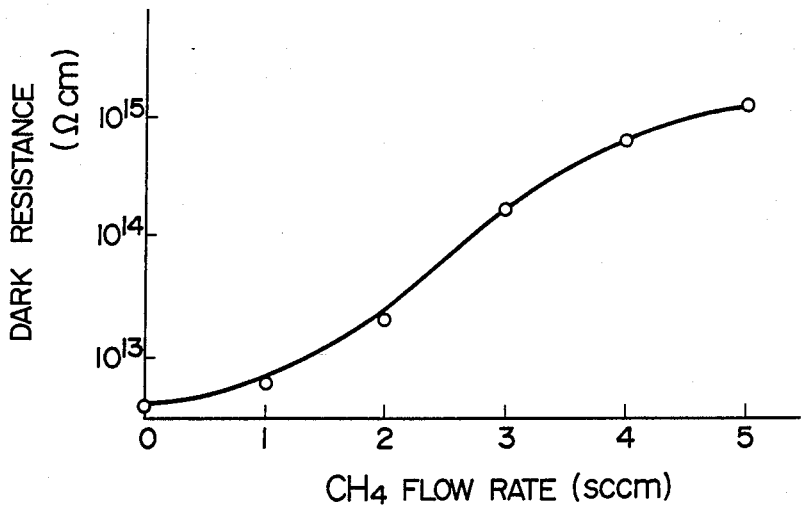
FIG. 4 is a diagram showing relationship between the methane flow rate and the dark resistance.
Figure 5:
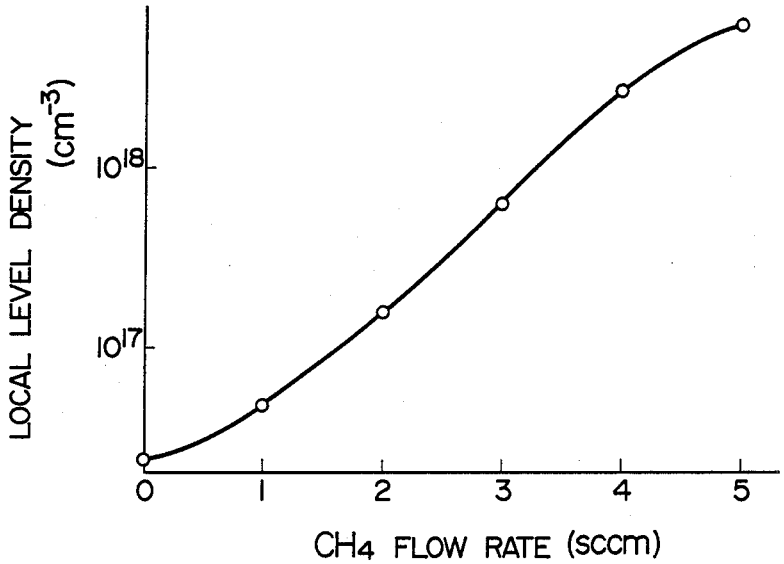
FIG. 5 is a diagram showing relationship between the methane flow rate and the local level density.

A plate-form aluminum support was set in a reactive sputtering apparatus shown in FIG. 3, and subjected to sputtering. The aluminum support was controlled to 250° C. Argon was passed therethrough at 18 sccm, hydrogen at 12 sccm, and methane at any of 0, 1, 2, 3, 4 and 5 sccm. The sputtering pressure was adjusted to 5 m Torr. Hydrogen-containing amorphous silicon carbide was formed on the aluminum support. The thus obtained samples were identified as a, b, c, d, e and f correspondingly. Relationship bedtween the methane flow rate and the dark resistance and that between the methane flow rate and the density of localized states in this Example are shown in FIG. 4 and FIG. 5, respectively. The local level density was determined with an electron spin resonance (ESR) apparatus.

EXAMPLE 2

Figure 6:
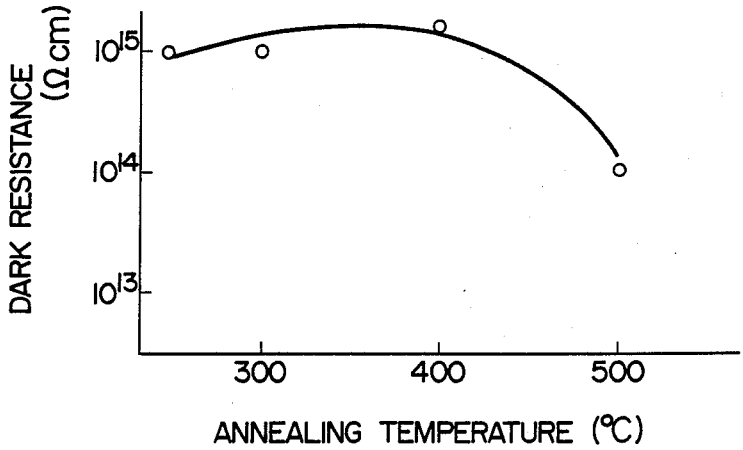
FIG. 6 is a diagram showing relationship between the annealing temperature and the dark resistance.
Figure 7:
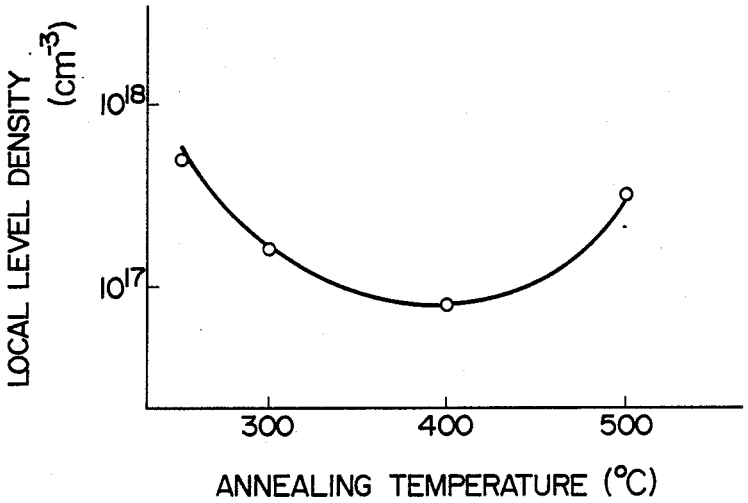
FIG. 7 is a diagram showing relationship between the annealing temperature and the local level density.

Sputtering was carried out onto an aluminum support in the same manner as in Example 1, except that the methane flow rate was 5 sccm, and when the desired film thickness was obtained, the power source 14 was turned off, and annealing was conducted at predetermined temperatures for one hour in the same atmosphere as that for the sputtering. Annealing temperatures were 250° C., 300° C., 400° C., and 500° C. Hydrogen-containing amorphous silicon carbide was formed on the aluminum support in the same manner as in Example 1. The thus obtained samples were identified as g, h, i and j correspondingly. Relationship between the annealing temperature and the dark resistance and that between the annealing temperature and the density of localized states are shown in FIG. 6 and FIG. 7, respectively.

EXAMPLE 3

A drum-form aluminum support was set in the sputtering device shown in FIG. 3, and subjected to sputtering.

At first, argon at 18 sccm, hydrogen at 12 sccm, and methane at 5 sccm were passed therethrough, and after presputtering, sputtering was carried out for 30 minutes, whereby a barrier layer of hydrogen-containing amorphous silicon carbide was formed. Then, supply of methane was discontinued and the high frequency power source 14 was turned off. Annealing was carried out at 300° C. for one hour, and then an amorphous silicon layer was sputtered for 36 hours, whereby a photoconductive layer of hydrogen-containing amorphous silicon was formed.

Again, the methane was passed therethrough, and sputtering was conducted for 30 minutes, whereby a surface protective layer of hydrogen-containing amorphous silicon carbide was formed. The methane flow rate and the annealing temperature were the same as in Examples 1 and 2, a to j, where the samples a to f were not subjected to annealing, and the samples g to j were subjected to annealing for one hour. Results of printing 10,000 sheets on the respective photosensitive drums are shown in Table 1. By annealing, the density of localized states was decreased, and the image quality was improved.

TABLE 1

| | Dark resistance (Ωcm) | of localized states density ($cm^{-3}$) | Resolution of transferred image |
|---|---|---|---|
| a | $4 \times 10^{12}$ | $3 \times 10^{16}$ | X |
| b | $6 \times 10^{12}$ | $4 \times 10^{16}$ | X |
| c | $2 \times 10^{13}$ | $2 \times 10^{17}$ | X |
| d | $2 \times 10^{14}$ | $6 \times 10^{17}$ | X |
| e | $6 \times 10^{13}$ | $3 \times 10^{18}$ | X |
| f | $1 \times 10^{15}$ | $6 \times 10^{18}$ | X |
| g | $1 \times 10^{15}$ | $5 \times 10^{17}$ | ○ |
| h | $1 \times 10^{15}$ | $2 \times 10^{17}$ | ○ |
| i | $2 \times 10^{15}$ | $8 \times 10^{16}$ | ◎ |
| j | $1 \times 10^{14}$ | $3 \times 10^{18}$ | X |

Remarks: ◎ quite good, : good, X: poor

EXAMPLE 4

A drum-form aluminum support was set in the sputtering apparatus shown in FIG. 3, and subjected to sputtering.

At first, argon at 18 sccm, hydrogen at 12 sccm, and methane at 5 sccm were passed therethrough, and after presputtering, sputtering was carried out for 30 minutes to form a barrier layer. Presputtering, methane flow rate for forming the barrier layer, and annealing temperature were the same as in Examples 1 and 2, a to j, where the samples a to f were not subjected to annealing and the samples g to j were subjected to annealing for one hour while turning off the high frequency power source 14.

Then, the supply of methane was discontinued, and sputtering was carried out for 36 hours. Again, methane was passed therethrough at 5 sccm, and sputtering was carried out for 30 minutes. Then, the high frequency power source 14 was turned off, and annealing was carried out at 300° C. for one hour. Results of printing 10,000 sheets on the respective photosensitive drums are shown in Table 2. By annealing, the density of localized states was decreased, and the adhesion was improved.

TABLE 2

| | Dark resistance (Ωcm) | Local level density of localized states ($cm^{-3}$) | Resolution of transferred image | Drum reeling |
|---|---|---|---|---|
| a | $4 \times 10^{12}$ | $3 \times 10^{16}$ | X | none |
| b | $6 \times 10^{12}$ | $4 \times 10^{16}$ | X | none |
| c | $2 \times 10^{13}$ | $2 \times 10^{17}$ | X | none |
| d | $2 \times 10^{14}$ | $6 \times 10^{17}$ | X | occurred |
| e | $6 \times 10^{13}$ | $3 \times 10^{18}$ | X | occurred |
| f | $1 \times 10^{15}$ | $6 \times 10^{18}$ | X | occurred |
| g | $1 \times 10^{15}$ | $5 \times 10^{17}$ | ○ | none |
| h | $1 \times 10^{15}$ | $2 \times 10^{17}$ | ○ | none |
| i | $2 \times 10^{15}$ | $8 \times 10^{16}$ | ◎ | none |
| j | $1 \times 10^{14}$ | $3 \times 10^{18}$ | X | none |

Remarks: : quite good, : good, X: poor

As is apparent from the foregoing, deterioration can be suppressed and adhesion to the photoconductive layer can be improved by providing a surface protective layer having a low density of localized states and a high dark resistance on the surface of the photoconductive layer.

What is claimed is:

1. A process for producing an electrophotographic photosensitive device, which comprises forming a photoconductive layer on an electroconductive support, and forming on said photoconductive layer a surface protective layer, said surface protective layer being formed of a material selected from the group consisting of amorphous silicon nitride, amorphous silicon carbide, amorphous silicon oxide, and mixtures thereof, wherein said forming the surface protective layer includes the substeps of depositing said material for the surface protective layer and annealing the deposited material, the annealing being performed at a temperature within a range of 250°–400° C. in an atmosphere in which the material was deposited or in an inert atmosphere so as to provide a layer having a density of localized states of not more than $5\times10^{17}$ $cm^{-3}$ and a higher dark resistance than that of the photoconductive layer.

2. A process for producing an electrophotographic photosensitive device according to claim 1, wherein the substep of depositing is performed by sputter deposition.

3. A process for producing an electrophotographic photosensitive device according to claim 2, wherein the material for the surface protective layer is hydrogen-containing amorphous silicon carbide.

4. A process for producing an electrophotographic photosensitive device according to claim 1, wherein annealing is carried out in a hydrogen-containing atmosphere so as to compensate for any hydrogen discharged from the surface protective layer during the annealing.

5. A process for producing an electrophotograhic photosensitive device, which comprises forming a barrier layer on an electroconductive support, forming a photoconductive layer on said barrier layer, and forming a surface protective layer on the photoconductive layer, the surface protective layer being formed of a material selected from the group consisting of amorphous silicon nitride, amorphous silicon carbide, amorphous silicon oxide, and mixtures thereof, wherein the forming of each of the barrier layer and the surface protective layer includes and substeps of depositing a material for the barrier layer and depositing said material for the surface protective layer, respectively, and annealing the deposited materials for the barrier and surface protective layers, the annealing being performed at a temperature within a range of 250°–400° C. in an atmosphere in which the material of the surface protective layer was deposited or in an inert atmosphere, so as to provide each of the barrier layer and the surface protective layer to have a density of localized states of not more than $5\times10^{17}$ $cm^{-3}$ and a higher dark resistance than that of the photoconductive layer.

6. A process for producing an electrophotographic photosensitive device according to claim 5, wherein the depositing of material for each of the barrier layer and the surface protective layer is performed by sputter deposition.

7. A process for producing an electrophotographic photosensitive device according to claim 6, wherein the material for each of the barrier layer and the surface protective layer is hydrogen-containing amorphous silicon carbide.

8. A process for producing an electrophotographic photosensitive device according to claim 5, wherein the annealing is carried out in a hydrogen-containing atmosphere so as to compensate for any hydrogen discharged from the surface protective layer during the annealing.

9. A process for producing an electrophotographic photosensitive device according to claim 1, wherein the annealing is performed so as to provide a surface protective layer having a density of localized states of between $8\times10^{16}$ to $5\times10^{17}$ $cm^{-3}$.

10. A process for producing an electrophotographic photosensitive device according to claim 9, wherein the material for the surface protective layer is hydrogen-containing amorphous silicon carbide.

11. A process for producing an electrophotographic photosensitive device according to claim 10, wherein the surface protective layer is formed so as to have a dark resistance of at least $5\times10^{13}$ Ω·cm.

12. A process for producing an electrophotographic photosensitive device according to claim 11, wherein the annealing is performed in an atmosphere having an elevated hydrogen partial pressure so as to compensate for hydrogen discharged from the deposited material during the annealing.

13. A process for producing an electrophotographic photosensitive device according to claim 12, wherein the material is deposited by chemical vapor deposition.

14. A process for producing an electrophotographic photosensitive device according to claim 12, wherein the material is deposited by sputter deposition.

15. A process for producing an electrophotographic photosensitive device according to claim 12, wherein the surface protective layer has a thickness of 0.05 to 0.2 μm.

16. A process for producing an electrophotographic photosensitive device according to claim 1, wherein the annealing is performed so as to provide a layer having a density of localized states of not more than $10^{17}$ $cm^{-3}$.

17. A process for producing an electrophotographic photosensitive device according to claim 1, wherein the material for the surface protective layer is hydrogen-containing amorphous silicon carbide.

18. A process for producing an electrophotographic photosensitive device according to claim 5, wherein the material for the barrier layer is selected from said group.

19. A process for producing an electrophotographic photosensitive device according to claim 5, wherein the material for the barrier layer and the material for the surface protective layer are the same material.

20. A process for producing an electrophotograhpic photosensitive device according to claim 5, wherein the annealing is performed so as to provide a surface protective layer having a density of localized states of between $8\times10^{16}$ to $5\times10^{17}$ $cm^{-3}$.

21. A process for producing an electrophotographic photosensitive device according to claim 20, wherein the material for the surface protective layer is hydrogen-containing amorphous silicon carbide.

22. A process for producing an electrophotographic photosensitive device according to claim 21, wherein the surface protective layer is formed so as to have a dark resistance of at least $5\times10^{13}$ Ω·cm.

23. A process for producing an electrophotographic photosensitive device according to claim 22, wherein the annealing is performed in an atmosphere having an elevated hydrogen partial pressure so as to compensate for hydrogen discharged from the deposited material during the annealing.

24. A process for producing an electrophotograhic photosensitive device according to claim 5, wherein the material for the surface protective layer is hydrogen-containing amorphous silicon carbide.

* * * * *